US005807287A

United States Patent [19]

Cheng

[11] Patent Number: 5,807,287

[45] Date of Patent: Sep. 15, 1998

[54] MASSAGING APPARATUS WITH AUDIO SIGNAL CONTROL

[76] Inventor: Tzu-Keng Cheng, 197, Shin-Sheng St., Chung-Ho City, Taipei, Taiwan

[21] Appl. No.: 691,842

[22] Filed: Aug. 1, 1996

[51] Int. Cl.[6] ..... A61H 23/00; A61H 23/02

[52] U.S. Cl. ..... 601/60; 601/49; 601/57; 601/58

[58] Field of Search ..... 601/46, 47, 49, 601/56, 57, 58, 59, 60, 67, 69, 70

[56] References Cited

U.S. PATENT DOCUMENTS

| | | | |
|---|---|---|---|
| 3,835,844 | 9/1974 | Lang | 601/49 |
| 4,064,376 | 12/1977 | Yamada . | |
| 5,092,315 | 3/1992 | Bennett et al. | 601/49 |
| 5,216,769 | 6/1993 | Eakin | 601/49 |
| 5,437,607 | 8/1995 | Taylor | 601/49 |
| 5,437,608 | 8/1995 | Cutler | 601/49 |
| 5,462,515 | 10/1995 | Tseng | 601/49 |
| 5,553,148 | 9/1996 | Werle | 601/86 |

*Primary Examiner*—Robert A. Hafer
*Assistant Examiner*—Benjamin K. Koo
*Attorney, Agent, or Firm*—Beveridge, DeGrandi, Weilacher & Young, L.L.P.

[57] ABSTRACT

A massaging apparatus with audio signal control that includes an elongated pad, a power supplying system, a hand-held controller, an audio signal input system, and a plurality of vibration generators. The vibration generators are mounted in the elongated pad. The audio signal input system receives an external audio signal source either by a signal input line in wireless receiving mode or a microphone in wire receiving mode. The vibration generators are actuated under control of the controller responsive to the signal amplitude and frequency of the received audio signal. The controller is further provided with a plurality of LED indicators for visually indicating the operation of the vibration generators responsive to the signal amplitude and frequency of the audio signal.

6 Claims, 6 Drawing Sheets

5V
VCC
72
V2
GND
V1
VDD
71
DC 12V 42
41
43
S6
61
VCC
62
A 51
64
67
66
63
65
A
5V
S1
S2
S3
S4
S5
VDD
RB2
RB1
RB0
RB3
RB4
RB5
RB6
RB7
RA0
RA1
RA2
RA3
R1CC
MCLR
OS2/CK
OS1
VSS
1
2
3
4
5

MASSAGING APPARATUS WITH AUDIO SIGNAL CONTROL

BACKGROUND OF THE INVENTION

1. Field of the Invention

The present invention relates to a massaging apparatus, and more particularly to a massaging apparatus with an elongated pad incorporating an array of vibration generators capable of generating a vibrating oscillation responsive to an external audio signal source.

2. Brief Description of the Prior Art

The conventional massaging apparatus is designed to generate a mechanical vibration or movement to user's body. The other type of conventional massaging apparatus is capable of generating an series of electric current pulses to get an electrical massaging effect. However, the performance of the conventional massaging apparatus is limited to their original designed basic function.

In practical use, the conventional massaging apparatus was widely applied to various applications, such as therapeutic chairs or a hand-held electric relaxer in the past. In a typical application of the massaging apparatus, a chair incorporates a plurality of vibration generators on the seat frame or in the seat so that vibrating oscillations generated by the vibration generators may be transmitted into the structure of the chair for imparting a vibratory motion or movement to the person occupying the chair. No matter what the massaging apparatus is incorporated in applications, it is still limited to its original functions and impossible to obtain versatile performances. Therefore, there is a need to improve the massaging effect of the applications.

SUMMARY OF THE INVENTION

Consequently, the primary object of the present invention is to provide an improved massaging apparatus incorporating an array of vibration generators controllable by an external audio signal source via a controller to generate an improved vibrating oscillation responsive to the signal amplitude of the external audio signal.

The other object of the present invention is to provide a massaging apparatus with automatic control function. An audio signal input means is provided to receive the external audio signal source for automatic operation of the vibratory movements of the massaging apparatus. The audio signal input means receives the audio signal source either by an microphone or an audio signal line in accordance with the user's option. The received audio signal is further amplified by an amplifying system and then transmitted to a processor so as to actuate the vibration generators via a driving circuit. The vibration generators may be arranged in selective groups or arrays on an elongated pad to impart a variety of mechanical vibratory movements to the user's body, responsive to the tempo, rhythm and the signal amplitude of the external audio signal source.

The other object of the present invention is to provide a massaging apparatus with manual control function. A hand-held controller is provided to facilitate manual operation of the massaging apparatus. A plurality of control switches are arranged on the controller and electrically coupled to the processor. The processor may generate a series of control signals to actuate the vibration generators by detecting the condition of the control switches.

The other object of the present invention is to provide a massaging apparatus with a visual indicating device. Preferably, a plurality of LED indicators are arranged on the controller for visually indicating the operation of the vibration generators, responsive to the signal amplitude and frequency of the external audio signal.

The other object of the present invention is to provide is a massaging apparatus suitable to incorporate various applications, such as a mattress, chair, seat, pad, or the like. The massaging apparatus may be used in an indoor or an outdoor place. The vibration generators on the elongate pad may be arranged in various arrangement so as to achieve specific massaging effect to user's neck, shoulder, waist, buttocks, thigh, or leg.

In order that the present invention may more readily be understood, the following description is given, merely by way of example, reference being made to the accompanying drawings.

DESCRIPTION OF THE PREFERRED EMBODIMENT

Figure 1:
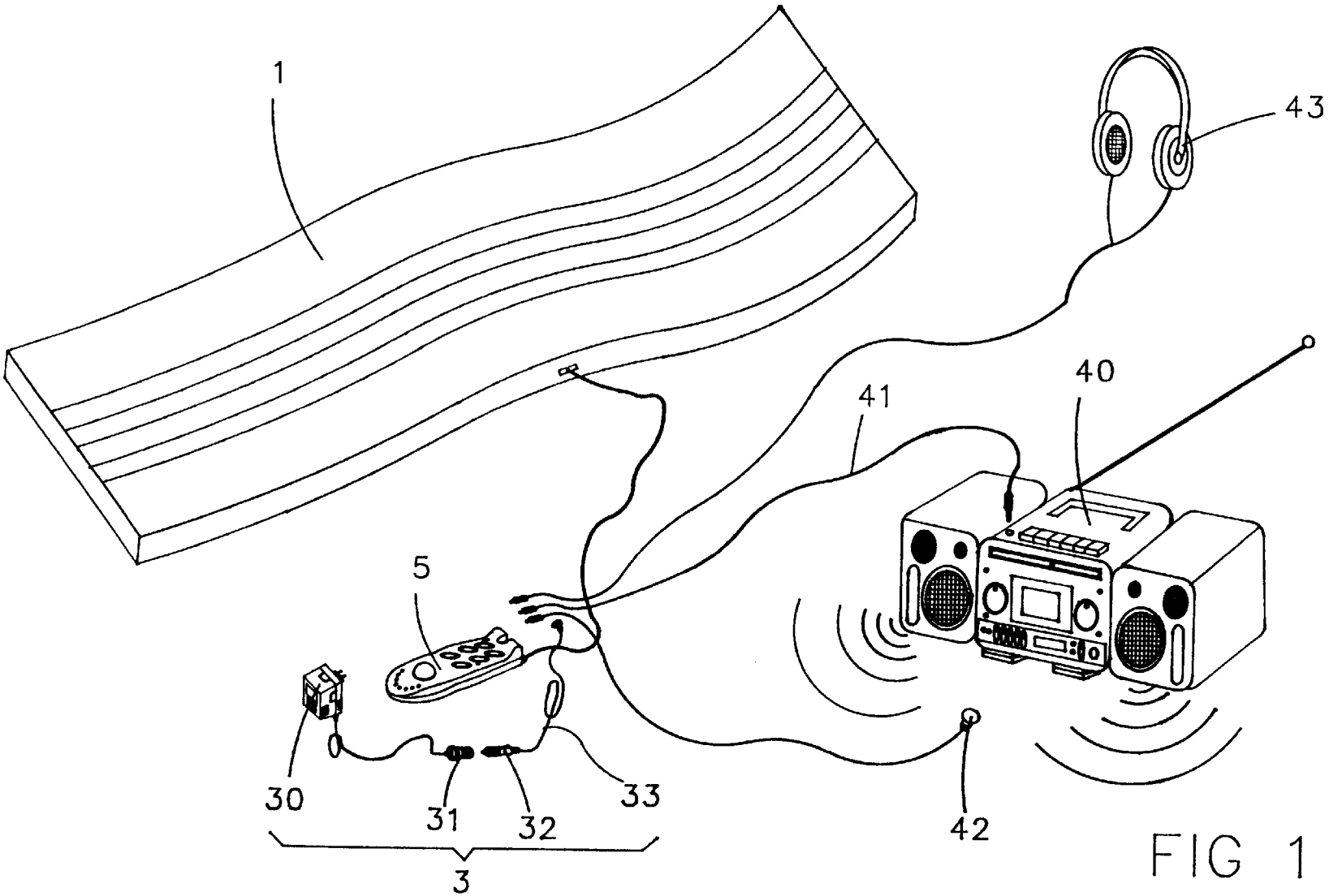
FIG. 1 is a perspective view of the massaging apparatus in accordance with a preferred embodiment of the present invention.
Figure 2:
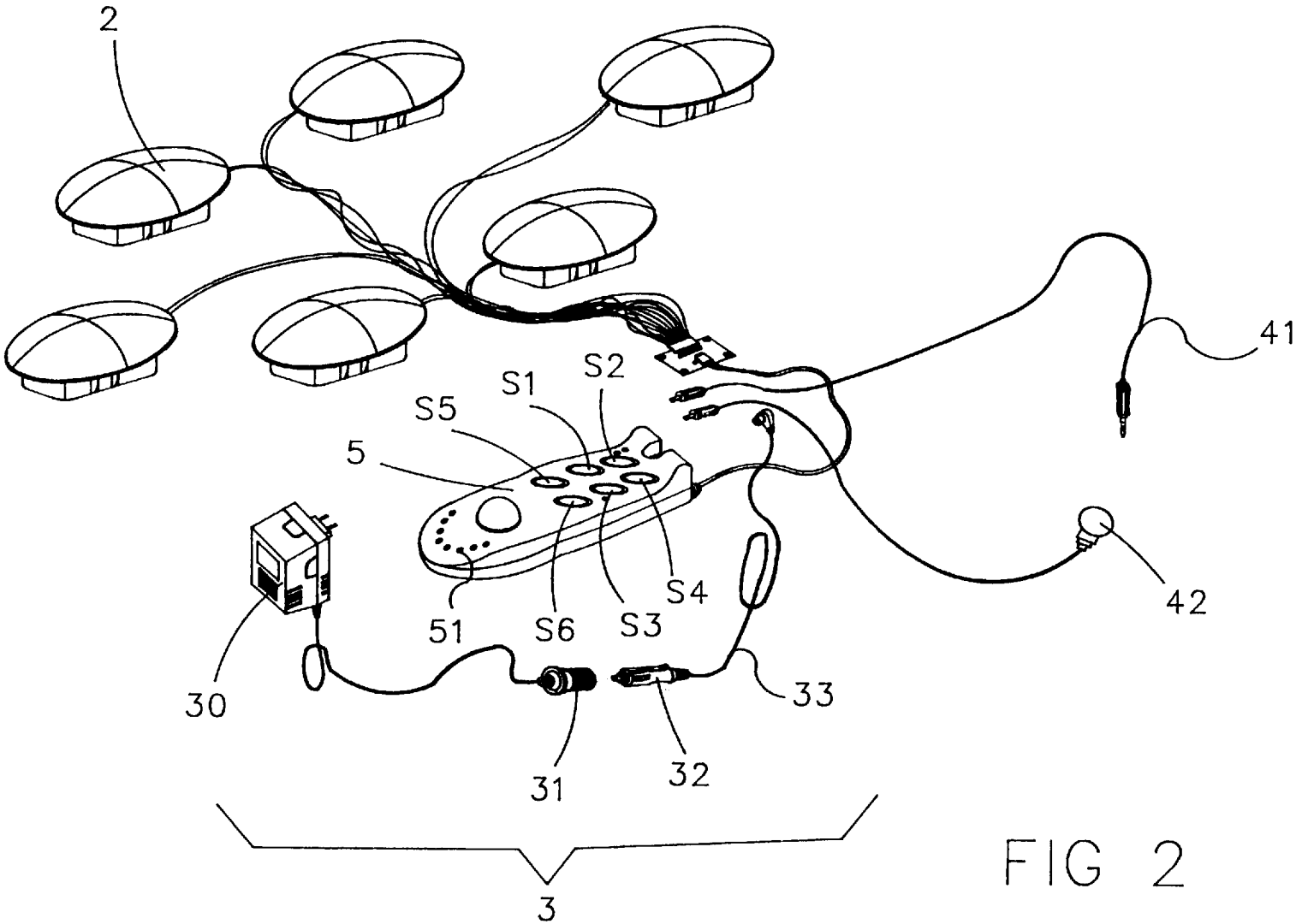
FIG. 2 is an exploded view showing the electrical wiring connection of the massaging apparatus of the present invention.

Referring now to FIGS. 1 and 2, FIG. 1 is a perspective view of the massaging apparatus in accordance with a preferred embodiment of the present invention. FIG. 2 is an exploded view of the massaging apparatus, showing the electrical wiring connection of the present invention. The massaging apparatus as an example mainly includes an elongated pad 1, a plurality of vibration generators 2, a power supplying system 3, and a hand-held controller 5. The elongated pad 1 is formed with a plurality of receptacles therein or thereon for receiving the vibration generators 2. The receptacles may be arranged on the elongate pad in selective groups or arrays.

A power supplying system 3 as an example includes a conventional adapter 30, a connector socket 31, a connector plug 32, and a power line 33 for supplying electric power source to the massaging apparatus. In practical use, the power source of the massaging apparatus may be obtained by plugging the adapter 30 into an indoor AC power socket or directly introducing a DC power source from a motor vehicle to the controller 5 via the power line 33.

An audio signal input system is capable of receiving an external audio signal source and transmitting the received audio signal to the controller 5. The controller 5 may actuate the vibration generators 2 in accordance with the tempo, the rhythm and the signal amplitude of the external audio signal source, such as music.

As shown in FIG.1 and FIG.2, the audio signal of an external audio source 40 may be directly transmitted into the controller 5 via a signal line 41. The external audio source 40 may be any commercial audio signal generating apparatus, such as a radio set, a portable radio set, or a television, and so on. The user may listen to the audio signal by means of earphones 43. Besides, the audio signal of the external audio source 40 may be received by a microphone 42 and transmitted to the controller 5. That is, the present invention may receive the external audio signal source by means of optional operations in wire receiving mode or wireless receiving mode.

The controller 5 is capable of receiving the audio signal either from the signal line 41 or the microphone 42, and then actuating the vibration generators 2 mounted in the elongated pad 1 in accordance with the signal amplitude of the audio signal source. So, the vibratory motion of the present invention is possible to incorporate the music to achieve versatile relaxing effects to the user's body.

The controller 5 includes a printed circuit board (not shown) and a control circuit which is arranged on the printed circuit board. As shown in FIG. 2, a plurality of control switches S1, S2, S3, S4, a control mode selecting switch S5, a wireless control selecting switch S6, and a plurality of indicators 51 on the surface of the controller 5.

The electrical wiring connection among the power supplying system 3, the controller 5, and the vibration generators 2 is illustrated in FIG. 2.

Figure 4:
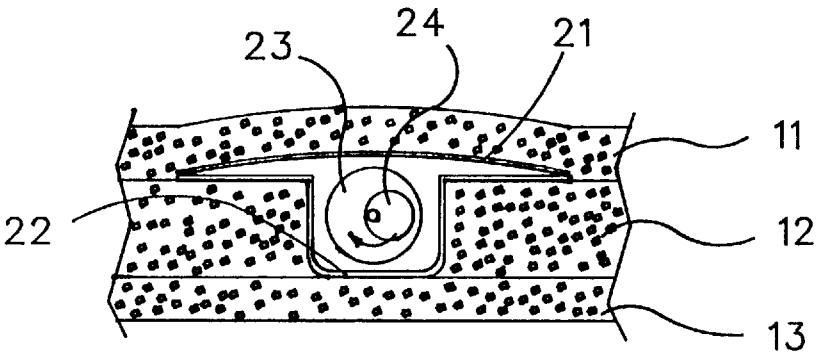
FIG. 4 is a cross-sectional view showing the vibration generator unit is mounted in the pad shown in FIG. 3.
Figure 3:
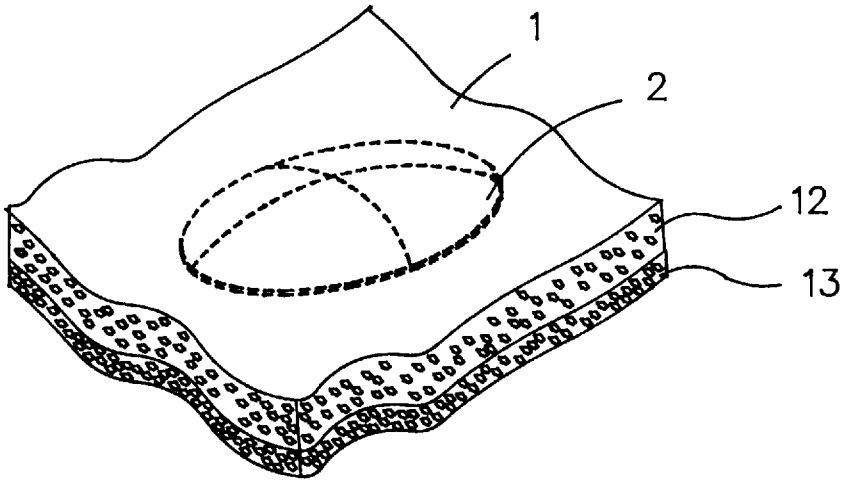
FIG. 3 is an enlarged perspective view illustrating a vibration generator unit carried on the pad shown in FIG. 1.

FIG. 3 illustrates a vibration generator unit 2 is mounted in a receptacle of the elongated pad 1. FIG. 4 illustrates a cross-sectional view of the vibration generator mounted in the elongated pad. In a preferred embodiment of the present invention, the elongated pad 1 includes three discrete layers: an upper sponge layer 11, a middle sponge layer 12 and a bottom sponge layer 13, as shown in FIG. 4.

The vibration generator 2 is composed of a protection cover 21, a receptacle base 22, a motor 23, and an eccentric weight 24. The receptacle base 22 is mounted in a receptacle of the elongated pad 1, and has an open top end for retaining the motor 23 therein. The protection cover 21 is used to cover the open top end of the receptacle base 22. The eccentric weight 24 is mounted on the drive shaft of the motor 23 for generating a jiggling vibration to the receptacle base 22 and the protection cover 21 during rotation of the drive shaft.

The upper sponge layer 11 is provided over the protection cover 21 and the pad 1 after the eccentric weight 24, the motor 23, the receptacle base 22, and the protection cover 21 are installed in the receptacle of the pad.

The user may manually control the massaging apparatus by means of operating the control switches and selecting switches arranged on the controller 5, so as to generate a massaging effect for the user's body. The massaging effect of the present invention may include the production of traveling vibratory motion, rolling motion or even in-place vibratory movement as applied to specified or random areas of the user's body.

Preferably, the operating mode and working situation of the massaging apparatus are visually indicated by the LED indicators 51 on the controller 5. For example, the LED indicators 51 may be actuated in flash operation or by lighting illuminance to indicate the signal amplitude and frequency of the audio signal source. The massaging apparatus may be used in a variety of forms, such as a mattress, chair, seat, or a separate cushion, or the like. In addition, the massaging apparatus may be designed to adapt to be used in various applications, such as inside or outside.

The vibration generators 2 in the elongated pad 1 may be actuated in various operation modes and arranged in selective groups or arrays to get simultaneous movements, a single movement, multiple programmable movements separately or in unison, or any combination thereof so as to achieve versatile massaging effects to user's neck, shoulder, waist, buttocks, thigh, or leg.

Figure 5:
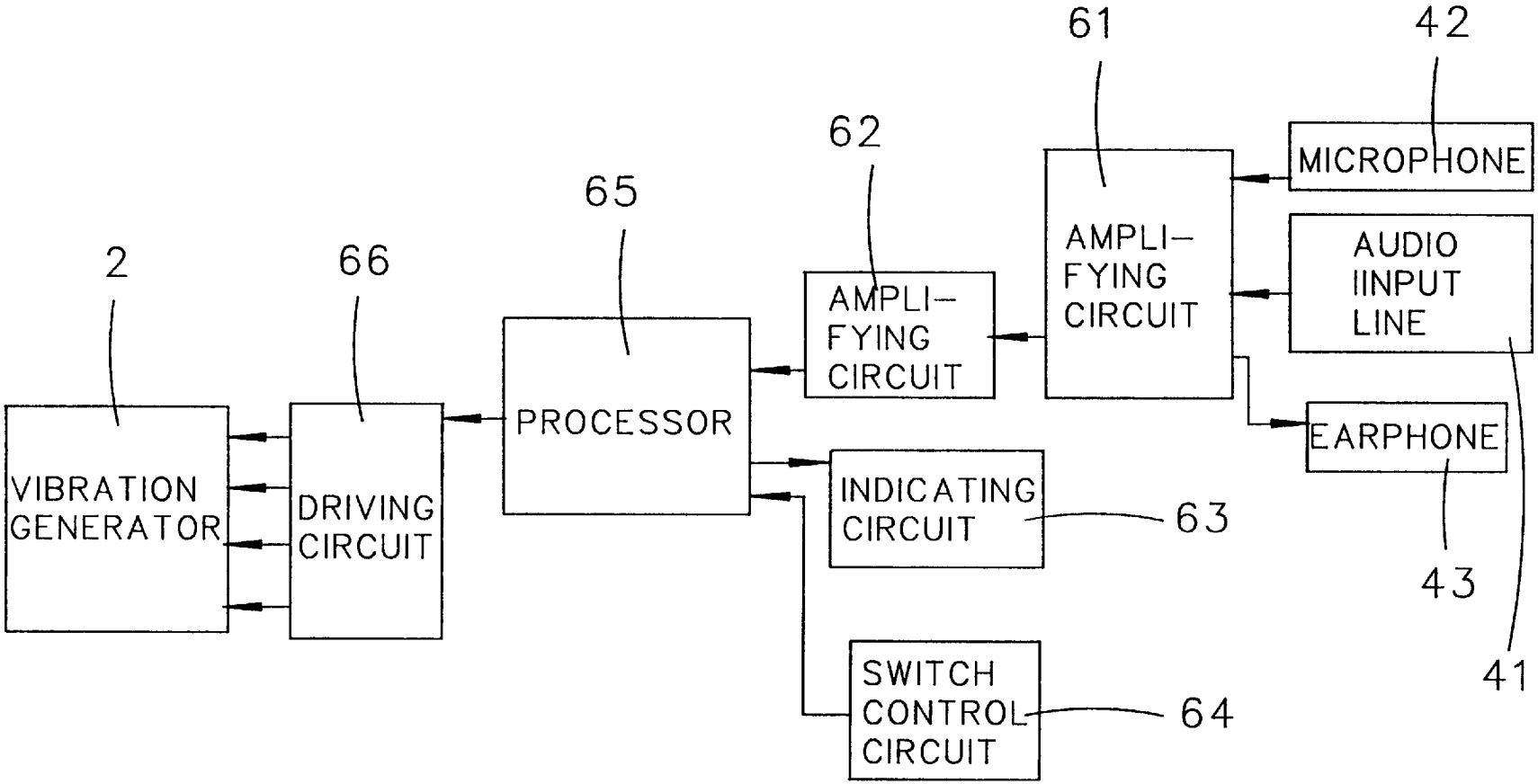
FIG. 5 is a functional block diagram of an electrical system of the present invention.

FIG. 5 is a functional block diagram of the present invention. The same reference numbers will be used throughout the drawing to refer to the same parts of the massaging apparatus mentioned above. The control circuit includes an audio signal input line 41, a microphone 42, an earphone 43, a first amplifying circuit 61, a second amplifying circuit 62, an indicating circuit 63, a switch control circuit 64, a processor 65, and a driving circuit 66. An external audio signal may be received by either the microphone 42 or the audio signal input line 41 and transmitted to the processor 65 via the first amplifying circuit 61 and the second amplifying circuit 62. The processor 65 generates a series of control signals to actuate the vibration generators 2 responsive to the output signal of the amplifying circuit. For example, the vibration generators 2 may generate vibratory movement responsive to the tempo, the rhythm and the signal amplitude of the output signal of the amplifying circuit. At the same time, the LED indicators 51 of the indicating circuit 63 are actuated by the processor 65 according to the tempo, the rhythm and the signal amplitude of the output signal of the amplifying circuit.

The processor 65 may detect the manual control command from the switch control circuit 64 when any one of the control switches of the switch control circuit 64 is depressed, and correspondingly actuate the vibration generators 2 via the driving circuit 66.

Figures 6A, 6B:
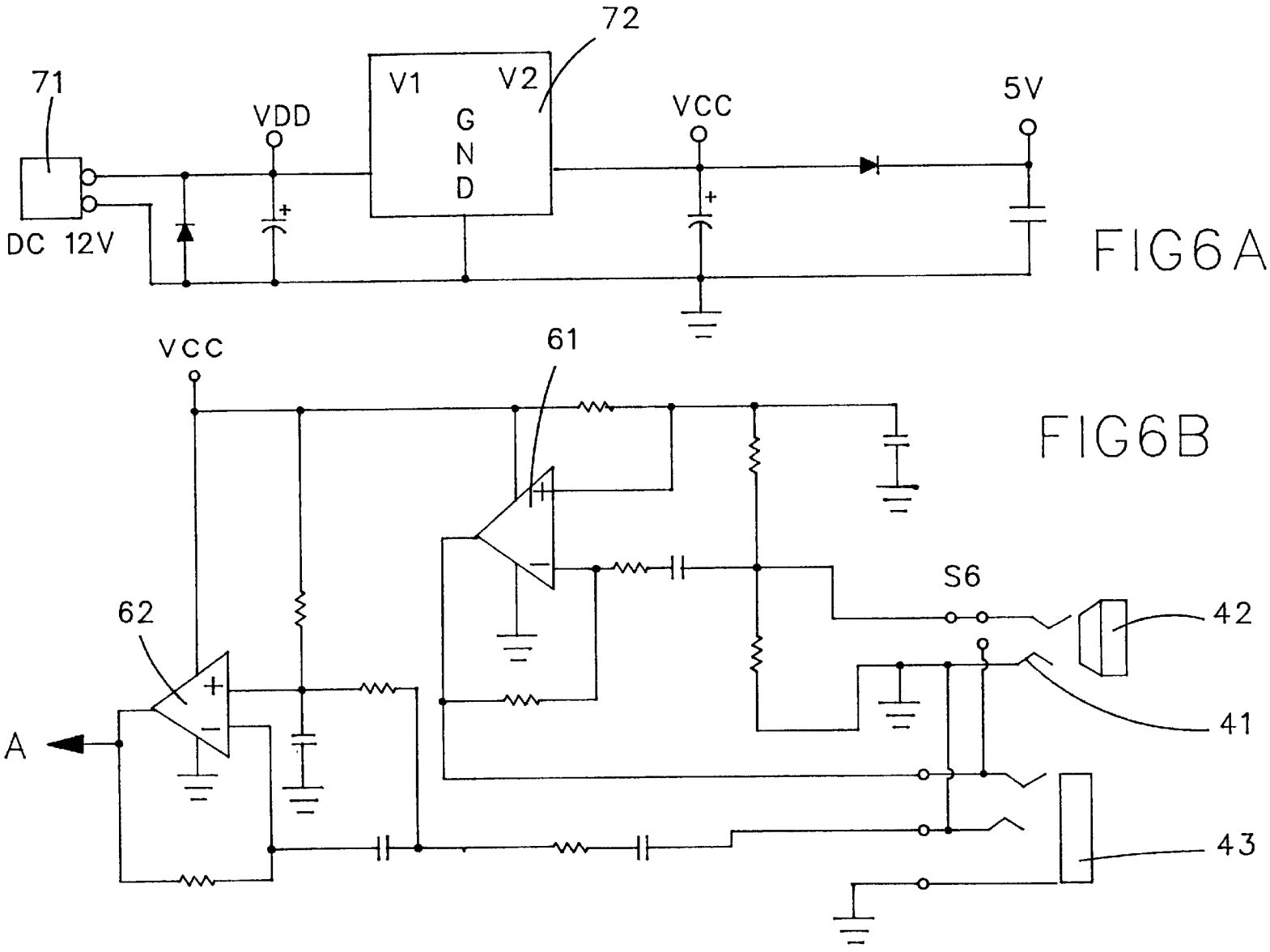
FIG. 6A to 6C depict a detailed control circuit of the electrical system illustrated in FIG. 5.
Figure 6C:
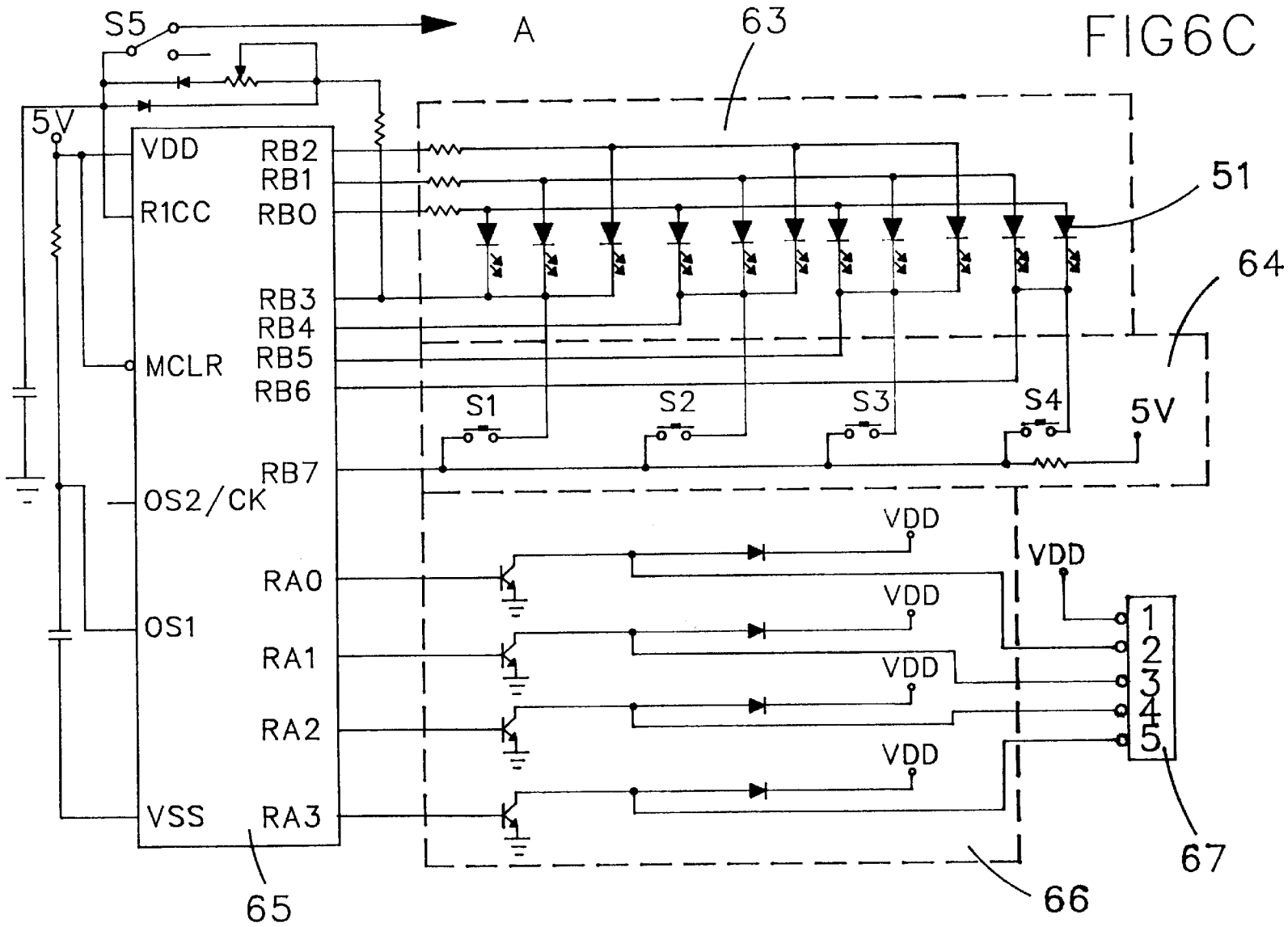

FIGS. 6A, 6B, and 6C in combination show a detailed control circuit of the present invention. FIG. 6A is a power supplying system which includes a voltage regulator 72. The voltage input terminal of the voltage regulator 72 is coupled to a DC 12 V electric power source connector 71. The power supplying circuit may supply a VDD, a VCC, and a 5 V electric power to the control circuit shown in FIG. 6B and 6C.

FIG. 6B is an audio signal input circuit of the present invention, serving as a receiving circuit for receiving and amplifying the external audio signal source. In the preferred embodiment of the present invention, as mentioned above, the external audio signal source may be received either by a microphone 42 in wireless receiving mode or by audio signal input line 41 in wire receiving mode. The received audio signal is amplified by a first amplifying circuit 61 and the second amplifying circuit 62, and then transmitted to a signal line A which is electrically coupled to the corresponding signal line labeled A in FIG. 6C. The user may listen to the audio signal by means of an earphone 43. A wireless control selecting switch S6 is used to select the operation modes, i.e. wire receiving mode or wireless receiving mode.

FIG. 6C shows a detailed control circuit of the indicating circuit 63, the switch control circuit 64, the processor 65, and the driving circuit 66. The indicating circuit 63 includes a plurality of LED indicators 51 which are arranged on the controller 5 and controlled by the processor 5.

The switch control circuit 64 includes four switches S1, S2, S3, and S4 arranged on the controller 5 as shown in FIG. 2. The control signal of the switch is sent to the processor 65 when the switch is depressed.

The processor 65 serves as a central processing unit of the present invention. The processor 65 may output control signals to actuate the vibration generators 2 via a driving circuit 66 and a connector 67 when detecting a specific switch of the switch control circuit is depressed.

Furthermore, as shown in FIG. 6B, the signal carried on signal line A is sent to the processor 65 via the control mode selecting switch S5. This switch is used to select that the massaging apparatus of the present invention is operated in audio signal control mode(i.e. automatic operation) or basic massaging function control(i.e. manual operation ). So, the user may select the operation mode of the present invention by means of simply controlling the control mode selecting switch S5. In the audio signal control mode, the operation of the vibration generates is controlled by the signal amplitude or signal frequency of the external audio signal automatically; while in the basic massaging function control mode, the vibration generators is controlled by the operation of the various switches on the controller manually.

In conclusion, from the detail description above, it is obvious that the massaging apparatus of the present invention has versatile massaging effects for the user's body, and therefore meets the requirements of patentability. While the arrangement and structure described above constitutes a preferred embodiment of this invention, it is to be understood that the present invention is not limited to this precise form and that changes may be made therein without departing from the scope and spirit of the invention as defined in the appended claims.

I claim:

1. A massaging apparatus with audio signal control comprising:

a power supplying means for supplying electric power to the massaging apparatus;

a controller connected to the power supplying means, the controller including a control circuit for controlling the massaging apparatus, a plurality of control switches and indicators arranged on the controller;

an elongated pad having at least three discrete layers, said at least three discrete layers comprising an upper sponge layer, a middle sponge layer below the upper sponge layer, the middle sponge layer having a plurality of receptacles passing therethrough, a bottom sponge layer below the middle sponge layer;

an audio signal input means for receiving an external audio source signal and transmitting the received audio signal to the control circuit of the controller; and a plurality of vibration generators mounted in the receptacles of the elongated pad and electrically connected to the controller;

wherein the audio signal from the audio signal input means is processed by the control circuit of the controller, and said control circuit drives the vibration generators mounted in the elongated pad in accordance with the signal amplitude of the audio signal.

2. The massaging apparatus as claimed in claim 1, wherein each of the vibration generators comprises:

a motor having a drive shaft;

a receptacle base mounted in a respective receptacle of the elongated pad, the receptacle base having an open top end for receiving the motor;

a protection cover covering the open top end of the receptacle base; and an eccentric weight mounted on the drive shaft of the motor for generating a jiggling vibration to the receptacle base and the protection cover during rotation of the drive shaft.

3. The massaging apparatus as claimed in claim 1, wherein the indicators are arranged on the top surface of the controller in a predetermined circular layout.

4. The massaging apparatus as claimed in claim 1, wherein the audio signal input means includes a microphone for receiving the external audio signal.

5. The massaging apparatus as claimed in claim 1, wherein the audio source input means includes an audio signal input line for receiving the external audio signal directly via the audio signal input line to the control circuit of the controller.

6. The massaging apparatus as claimed in claim 1, wherein the control circuit of the controller includes:

an audio signal input circuit for receiving the external audio signal;

a processing circuit for receiving and processing the audio signal from the audio signal input circuit;

an indicating circuit provided with a plurality of LED indicators connected to and controlled by the processing circuit for indicating the operating status of the massaging apparatus according to the signal amplitude of the received audio signal; and a switch means electrically connected to the processing circuit for manually controlling the massaging apparatus.

* * * * *